United States Patent [19]

Neumann et al.

[11] Patent Number: 4,911,732

[45] Date of Patent: Mar. 27, 1990

[54] LIGHT FASTNESS OF POLYESTER DYEINGS USING BENZOPHENONE ETHER ESTERS, AND NOVEL BENZOPHENONE ETHER ESTERS

[75] Inventors: Peter Neumann, Wiesloch; Dieter Wegerle, Mannheim; Reinhold Krallmann, Weisenheim, all of Fed. Rep. of Germany

[73] Assignee: BASF Aktiengesellschaft, Ludwigshafen, Fed. Rep. of Germany

[21] Appl. No.: 250,118

[22] Filed: Sep. 28, 1988

[30] Foreign Application Priority Data

Sep. 30, 1987 [DE] Fed. Rep. of Germany ..... 3732980

[51] Int. Cl.[4] ..... C07D 213/55; C07D 333/38; D06P 3/54; C07C 121/76

[52] U.S. Cl. ..... 8/442; 8/490; 8/568; 8/575; 8/582; 8/583; 8/607; 8/610; 8/922; 560/9; 560/103; 560/105; 560/107

[58] Field of Search ..... 8/442, 583, 607, 490

[56] References Cited

U.S. PATENT DOCUMENTS

| | | | |
|---|---|---|---|
| 3,644,485 | 2/1972 | Lappin et al. | 560/85 |
| 3,676,471 | 7/1972 | Eggensperger et al. | 260/410.5 |
| 4,101,511 | 7/1978 | Floyd et al. | 524/120 |
| 4,789,382 | 12/1988 | Neumann et al. | 8/442 |
| 4,824,892 | 4/1989 | Eiglmeier et al. | 524/291 |

FOREIGN PATENT DOCUMENTS

| | | |
|---|---|---|
| 60-126246 | 7/1985 | Japan . |
| 852977 | 11/1960 | United Kingdom . |

*Primary Examiner*—A. Lionel Clingman
*Attorney, Agent, or Firm*—Oblon, Spivak, McClelland, Maier & Neustadt

[57] ABSTRACT

Improved light fastness of dyeings on textile polyester material with disperse dyes is obtainable by dyeing in the presence of certain benzophenone ether esters, some of which are novel.

4 Claims, No Drawings

LIGHT FASTNESS OF POLYESTER DYEINGS USING BENZOPHENONE ETHER ESTERS, AND NOVEL BENZOPHENONE ETHER ESTERS

The present invention relates to a process for dyeing textile polyester material with disperse dyes using benzophenone ether esters to improve the light fastness, the use of these benzophenone ether esters for dyeing textile polyester material, and novel benzophenone ether esters as such.

German Published Application DAS 1,156,760 discloses for example a process for improving the light fastness of polyester dyeings by treating the fibers in a boiling aqueous dyebath which contains alkyl ethers of 2,2',4,4'-tetrahydroxybenzophenone, as well as the dye. In this process, the benzophenone derivative goes onto the fiber together with the dye. If the fiber thus dyed is exposed in an exposure instrument (for example a Xenotest or Fadeometer) it has a better light fastness than a fiber dyed in the absence of the tetrahydroxybenzophenone derivative.

However, the compounds described in German Published Application DAS 1,156,760 have a number of disadvantages, viz. owing to their self-color they shift the hue in particular in the case of brilliant dyeings and have a certain dulling effect on the dyeing. Their exhaustion onto textile structures is not sufficient, so that dye-house effluent is polluted with organic compounds. In addition, the compounds mentioned tend to sublime in the thermal aftertreatment customarily carried out following dyeing.

German Laid-Open Application DOS 2,017,825 discloses that 2-hydroxy-4-(2-hydroxyethoxy)benzophenone esters can be used as light stabilizers for plastics and polymers, for example polypropylene, polyvinyl chloride, polyesters or polyamides, these compounds being incorporated into the polymer mass or added to solutions and emulsions of surface coatings, in general paints and varnishes. It is not obvious from this prior art to use these compounds in a dye/textile polyester material system for stabilizing the dyes.

German Patent Application P 36 25 355.3 proposes benzophenone ether esters for improving the light fastness of dyeings on textile polyester material. The proposed compounds are substituted or unsubstituted 2-hydroxy-4-(2-hydroxyethyl)benzophenone esters where the ester moiety is derived from a monobasic organic acid.

It is an object of the present invention to provide, for the improvement of the light fastness of dyeings with disperse dyes on polyesters, substances which readily exhaust onto polyesters, which do not tend to sublime and which have virtually no impairing effect, if any, on the dyeings, in particular regarding their brilliance.

We have found that this object is achieved with a process for dyeing textile polyester material with disperse dyes in the presence of benzophenone derivatives to improve the light fastness, which comprises adding to the dyebath one or more benzophenone derivatives of the formula I

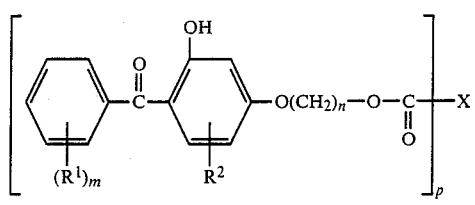

(I)

where $R^1$ is alkyl of from 1 to 4 carbon atoms, cyano, fluorine, chlorine, bromine or trifluoromethyl;

$R^2$ is hydrogen or alkyl of from 1 to 6 carbon atoms;

m is 0, 1 or 2, n is 2, 3 or 4,

P is 2, 3 or 4 and

X is a polyvalent organic radical derived from a polybasic aliphatic, cycloaliphatic, aromatic or heterocyclic acid, and in using the benzophenone derivatives of the formula I for improving the light fastness of dyed textile polyester material.

In the process according to the invention, unsubstituted benzophenone derivatives of the formula II

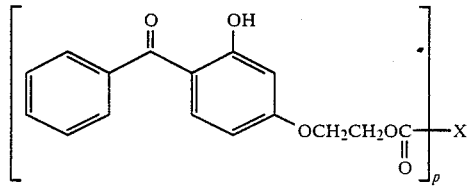

(II)

where p is 2, 3 or 4 and

X is a polyvalent organic radical derived from a polybasic aliphatic, cycloaliphatic, aromatic or heterocyclic acid, are particularly preferred.

The compounds of the formulae I and II, if derived from a 2-hydroxy-4-(2-hydroxyethoxy)benzophenone radical, are partly known from German Laid-Open Application DOS 2,017,825, and partly not previously described.

The present invention accordingly also provides the novel benzophenone derivatives of the formulae III to V

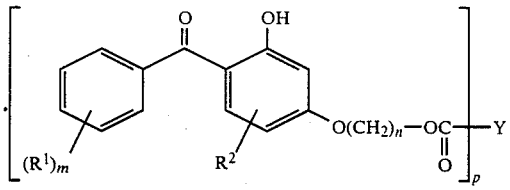

(III)

where Y is a polyvalent organic radical derived from a polybasic heterocyclic acid, and $R^1$, $R^2$, m, n and p are as defined for the formula I, the novel benzophenone derivatives of the formula IV

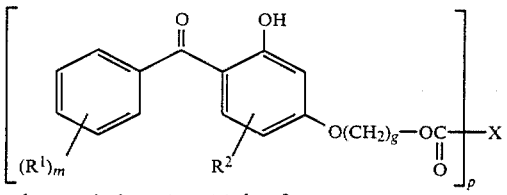

(IV)

where g is 3 or 4 and $R^1$, $R^2$, m and X are as defined in the formula I, and the novel benzophenone derivatives of the formula V

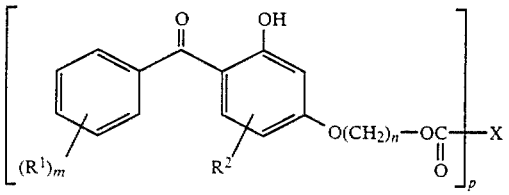

(V)

where $R^1$, $R^2$, m, n, p and X are as defined for the formula I, with the proviso that at least one of the radicals $R^1$ and $R^2$ must be different from hydrogen.

Observations concerning the abovementioned formulae I to V:

Alkyls $R^1$ and $R^2$ are for example methyl, ethyl, propyl, n-butyl and tert-butyl. Preferred radicals for $R^1$ are hydrogen, chlorine and methyl and for $R^2$ hydrogen and methyl.

Polybasic aliphatic, cycloaliphatic or aromatic acids underlying the radical X are for example: carbonic acid, oxalic acid, malonic acid, succinic acid, glutaric acid, 3,3-dimethylglutaric acid, adipic acid, pimelic acid, suberic acid, azelaic acid, sebacic acid, maleic acid, fumaric acid, glutaconic acid, itaconic acid, citric acid, tricarballylic acid, butane-1,2,3,4-tetracarboxylic acid, ethylenediaminetetraacetic acid, phthalic acid, isophthalic acid, terephthalic acid, hexahydrophthalic acid, hexahydroisophthalic acid, hexahydroterephthalic acid, 3- and 4-chlorophthalic acid, tetrachlorophthalic acid, m-phenylenediacetic acid, p-phenylenediacetic acid, m-phenylenedioxyacetic acid, p-phenylenedioxyacetic acid, 4,4'-oxydibenzoic acid, diphenic acid, 4,4'-biphenyldicarboxylic acid, 4,4'-sulfonyldibenzoic acid, 4,4'-benzophenonedicarboxylic acid, 2,6-naphthalenedicarboxylic acid, trimellitic acid, trimesic acid, pyrromellitic acid and hemimellitic acid.

Suitable polyvalent organic radicals derived from polybasic heterocyclic acids are the radicals derived from thiophene-2,5-dicarboxylic acid and pyridine-2,6-, pyridine-2,5- and pyridine-3,5-dicarboxylic acid. These acid radicals correspond in particular to the radical Y in the formula III.

In a general form, the polybasic acids can be expressed as $X(COOH)_p$ or $Y(COOH)_p$ where X, Y and p are as defined for the formulae I to V.

Preferred polybasic acids are succinic acid, glutaric acid, adipic acid, sebacic acid, phthalic acid, isophthalic acid, terephthalic acid, p-phenylenedioxyacetic acid and oxydibenzoic acid.

The novel compounds of the formulae III to V are prepared in a conventional manner by reacting an alcohol of the formula VIa or VIb

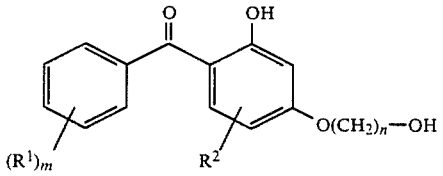

(VIa)

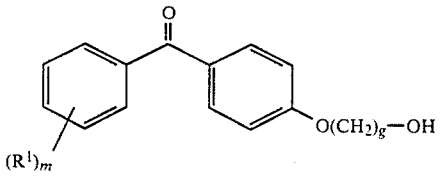

(VIb)

where $R^1$, $R^2$, m and n or g are as defined for the formulae III to V, with a polybasic acid $X(COOH)_p$, if compounds of the formulae IV and V are to be prepared, or with a polybasic acid $Y(COOH)_p$, if compounds of the formula III are to be prepared, X, Y and p being as defined above, in an inert solvent, in particular benzene, toluene or xylene, in the presence of an acid catalyst, in particular sulfuric acid, p-toluenesulfonic acid or a strongly acid ion exchanger, at reflux temperatures and working up in a conventional manner.

The above reaction comprises a conventional esterification of an alcohol of the formula VI with a polybasic organic acid which may be present in the form of its anhydride.

The starting compounds of the formula VI are known or, as in the case of $R^1$- and/or $R^2$-substituted compounds, obtainable by conversion of a corresponding substituted 2,4-dihydroxybenzophenone.

For example, 2-hydroxy-4-(β-hydroxyethoxy)-4'-chloro- and 2-hydroxy-4-(β-hydroxyethoxy)-4'-methylbenzophenone are obtained by customary reaction with ethylene oxide or ethylene carbonate from the corresponding 2,4-dihydroxy-4'-chloro- and 2,4-dihydroxy-4'-methyl-benzophenone.

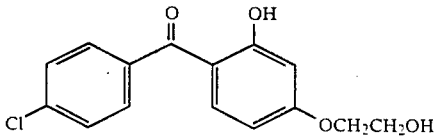

mp. 123–125° C.

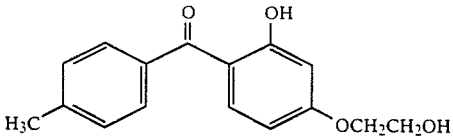

mp. 121–123° C.

Examples are the following compounds of the formulae III to V:

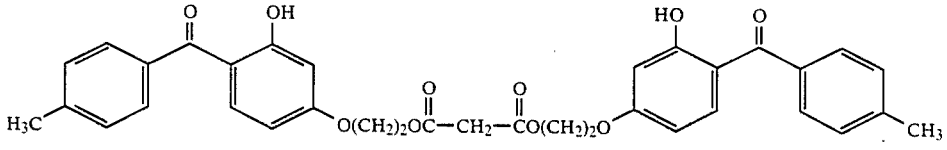

-continued
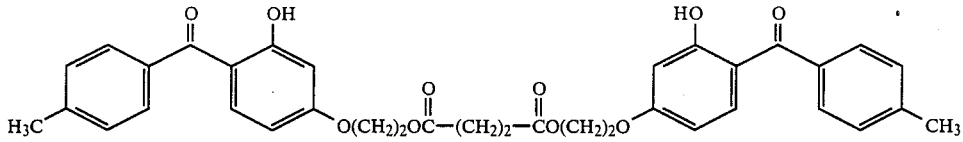
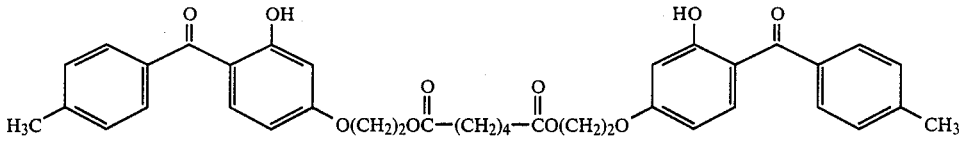
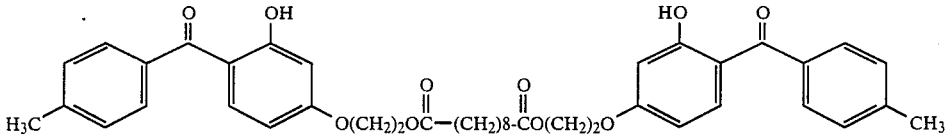
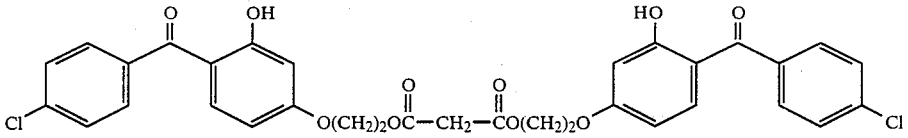
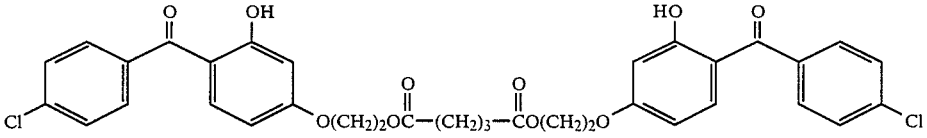
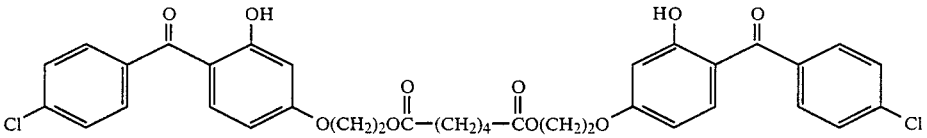
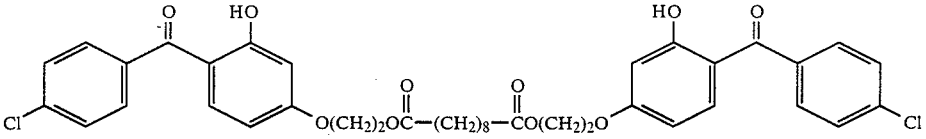
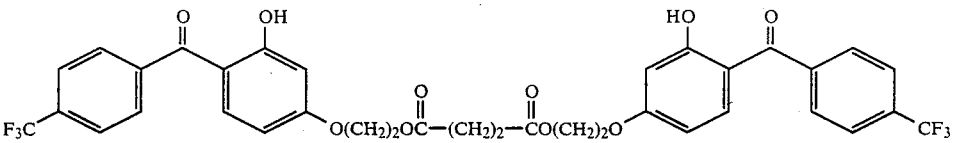
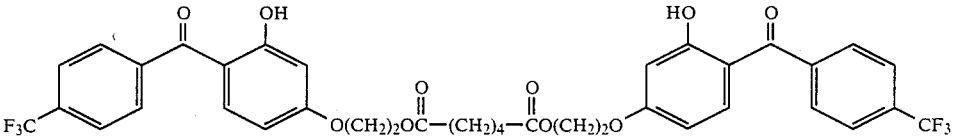
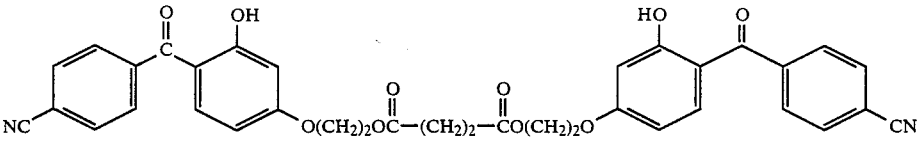
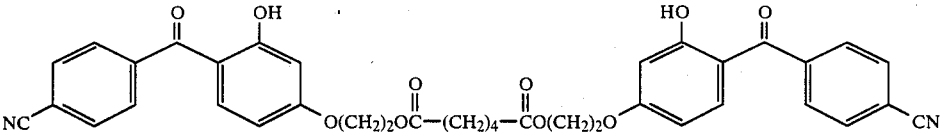

-continued
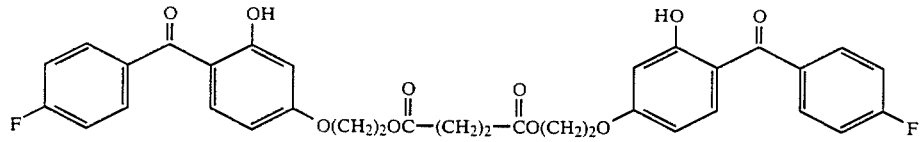
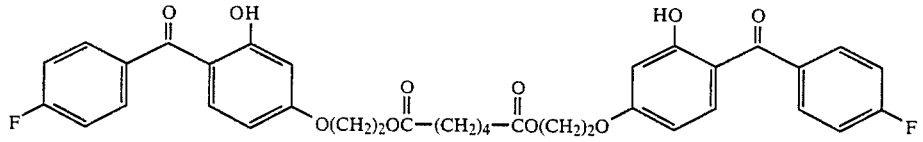
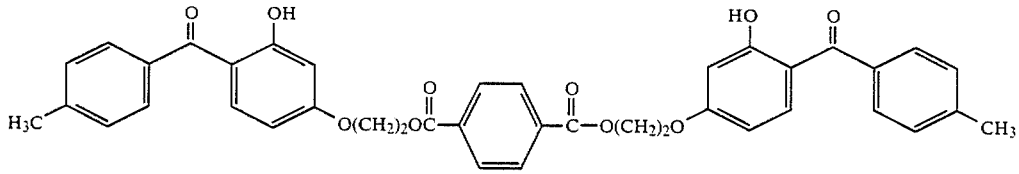
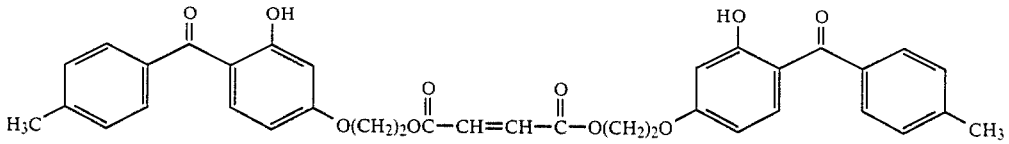
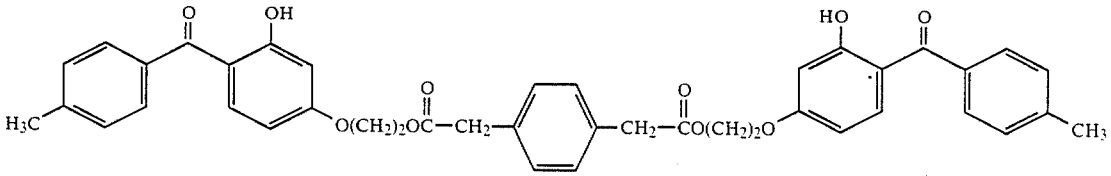
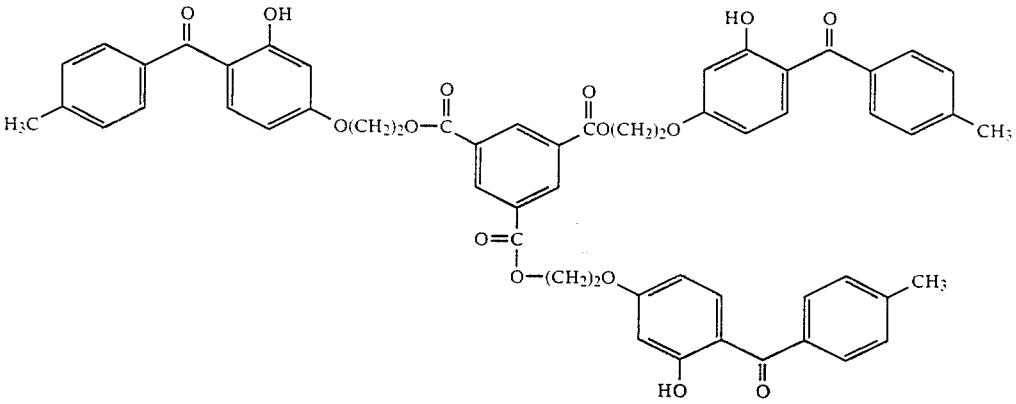
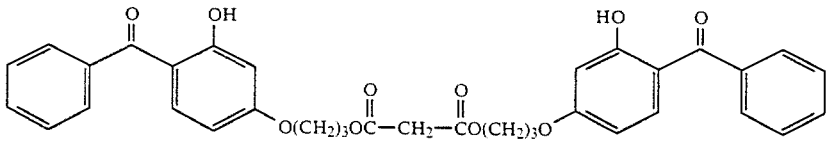
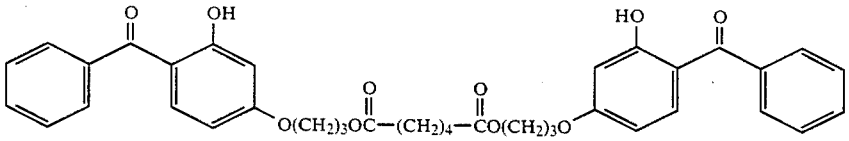
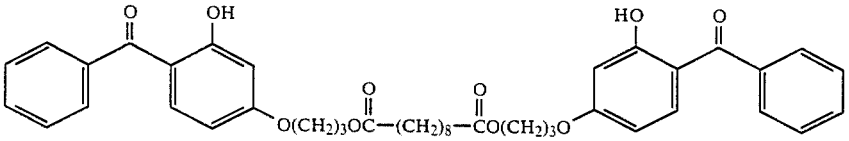

-continued
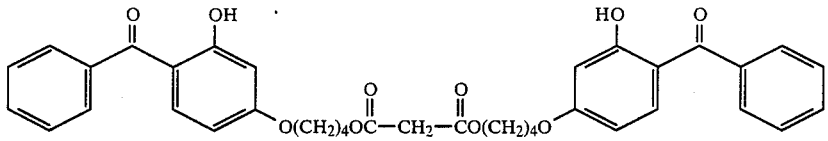
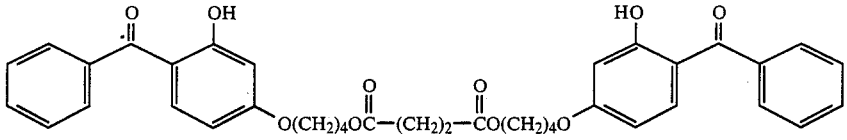
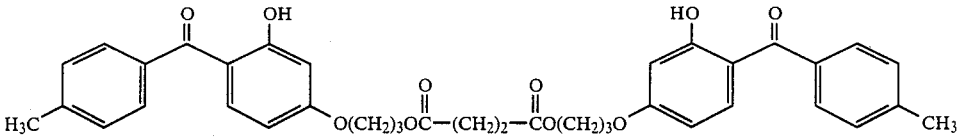
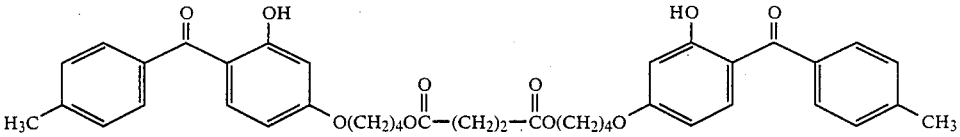
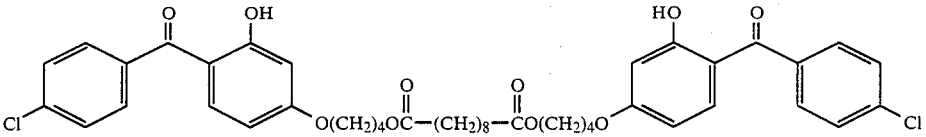
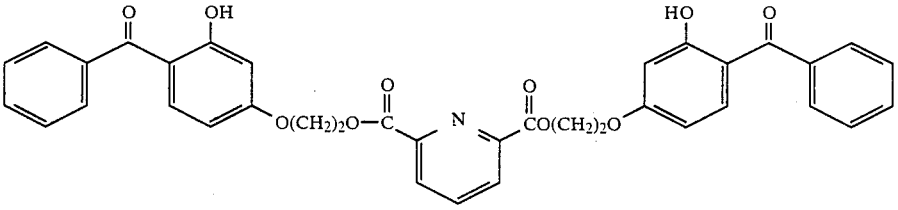
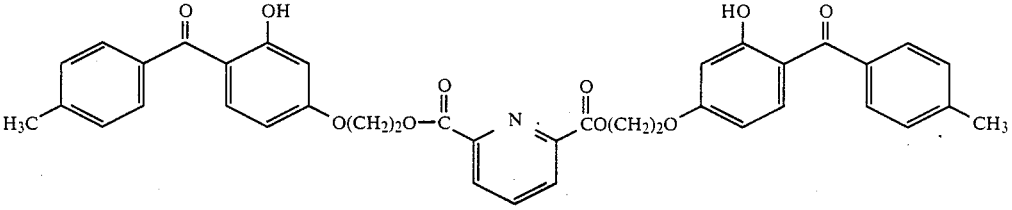
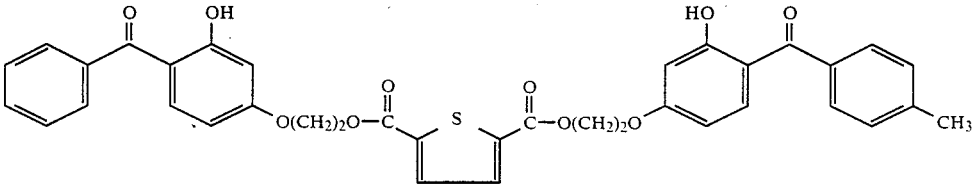
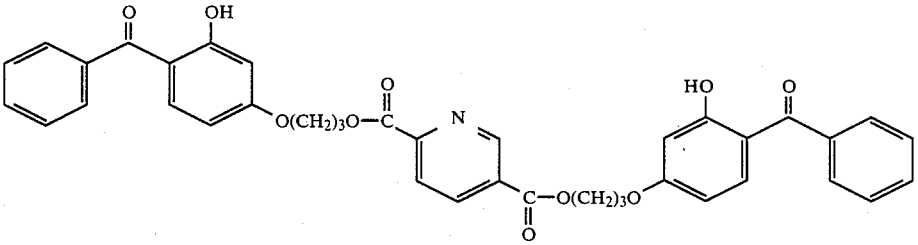

-continued

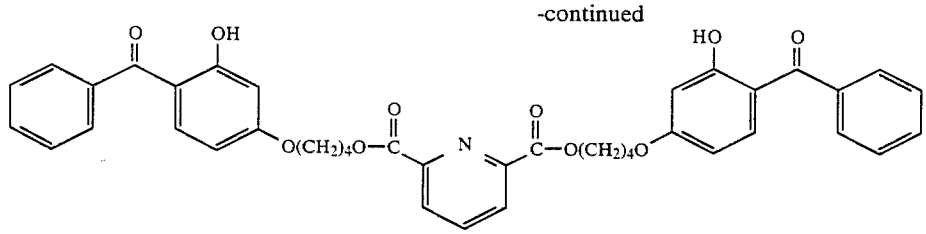

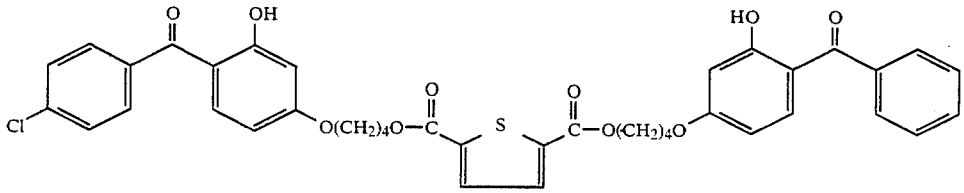

The process according to the invention is used to dye textile materials made of polyesters, in particular polyethylene terephthalates, such as polyethylene glycol terephthalate, in a conventional manner. Such textile materials are in particular structures such as fibers, yarns, films, woven fabrics and knitted fabrics. They can be dyed with conventional disperse dyes from existing dye classes, for example azo, anthraquinone, methine, quinophthalone and coumarin dyes, in a conventional manner, for example by the high-temperature process, by thermosoling or by means of carriers, as is discussed for example in the Ratgeber, Färben und Ausrüsten von Polyesterfasern und Polyesterfasermischungen, issued by BASF Aktiengesellschaft 1974.

In the process according to the invention, the benzophenone derivatives are added to the dyebaths in finely divided form, if desired in powder or liquid formulation. They are used in amounts of from 0.1 to 10, preferably from 0.3 to 5, % by weight, based on the textile material.

The dyeings obtained differ little if at all in hue from those obtained without the addition of benzophenone derivatives, but have a distinctly improved light fastness, and can even meet higher requirements, for example those of the automotive sector in respect of seat covers and the like.

Particularly preferred benzophenone ether esters for the process according to the invention are the diesters of succinic acid, glutaric acid, adipic acid, phthalic acid and p-phenylenedioxyacetic acid with 2-hydroxy-4-(2-hydroxyethoxy)benzophenone.

Particular advantages over existing benzophenone derivatives as described in German Published Application DAS 1,156,760 are that the compunds to be used according to the invention have appreciably less self-color and hence have virtually no effect on the hue of dyeings. While for example 2,2'-dihydroxy-4,4'-dimethoxyphenone gives a dyebath exhaustion of about 75%, the compounds to be used according to the invention attain degrees of exhaustion of the order of from 85 to 100%. With existing compounds the sublimation losses (30 sec. at 190° C.) are from 20 to 25%, based on the substance on the fiber, while with the compounds to be used according to the invention lie below 10%.

In the application examples, parts are by weight.

APPLICATION EXAMPLE 1

100 parts of a polyester yarn are treated in a dyebath containing 1500 parts of water, 0.6 part of a mixture of the finely divided dyes I (0.30 part)

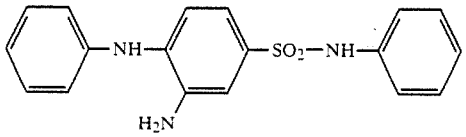

II (0.06 part)

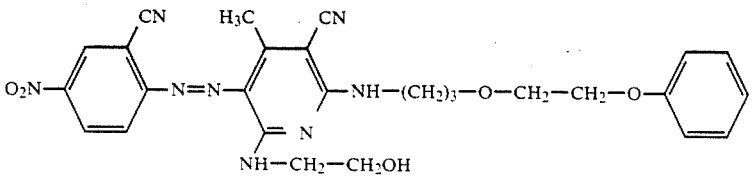

III (0.24 part)

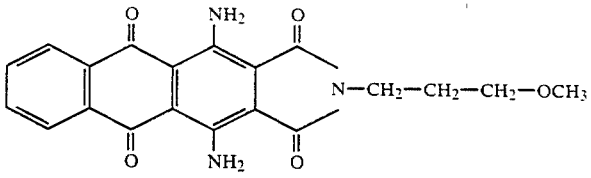

1.8 parts of a dyeing assistant obtained by addition of 50 moles of ethylene oxide onto 1 mole of sperm oil alcohol and subsequent sulfonation and 1.5 parts of the finely divided benzophenone compound of the formula

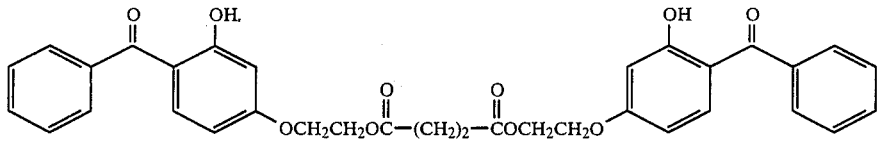

The treatment starts at 60° C., the temperature is raised to 130° C. in the course of 20 minutes and dyeing is continued at that temperature for a further 90 minutes in an HT dyeing machine.

A brown dyeing is obtained which on exposure in a Xenotest under moist-hot conditions (for example temperature at 75° C., relative humidity 80%) is distinctly lightfaster than the same dyeing without the addition of the benzophenone compound.

APPLICATION EXAMPLE 2

100 parts of a knitted polyester fabric are treated in a dyebath containing 2500 parts of water, 1.2 parts of a mixture of finely divided dyes I (0.18 part)

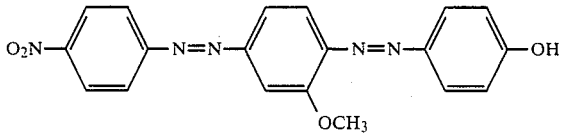

II (0.06 part)

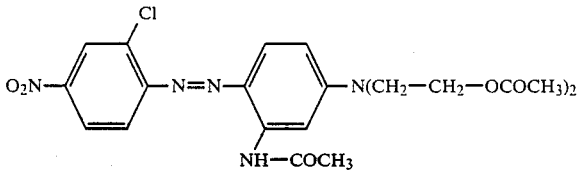

III (0.42 part)

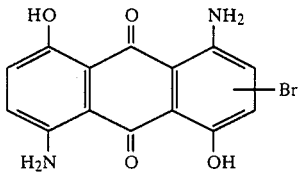

5 parts of a carrier based on methyl salicylate and 2 parts of the finely divided benzophenone compound of the formula

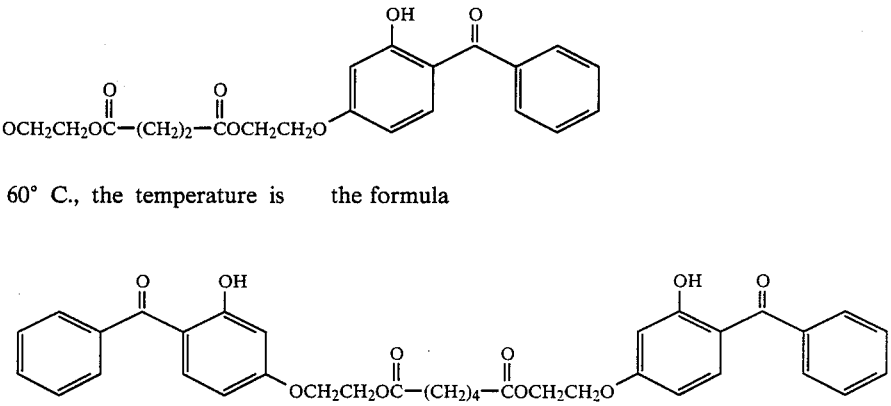

The fabric is dyed at the boil for 90 minutes to give a reddish brown dyeing which in an exposure test in a fadeometer gives distinctly better results than the same dyeing without the addition of the benzophenone compound.

APPLICATION EXAMPLE 3

A woven polyester fabric is padded on a three-roll pad-mangle with a dyeing liquor containing per 1000 parts 25 parts of a mixture of finely divided dyes I (12.5 parts)

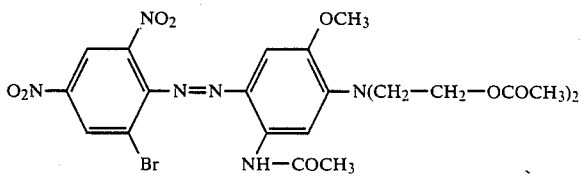

-continued

II (10.0 parts)

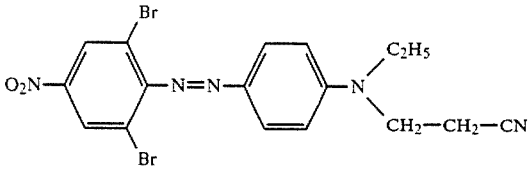

III (2.5 parts)

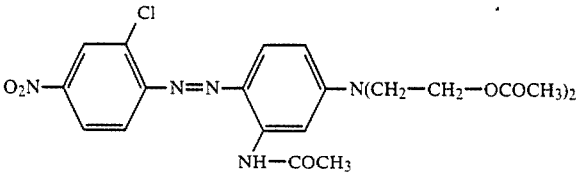

20 parts of a 20% strength aqueous solution of a copolymer of acrylic acid and acylamide, 25 parts of the finely divided benzophenone compound

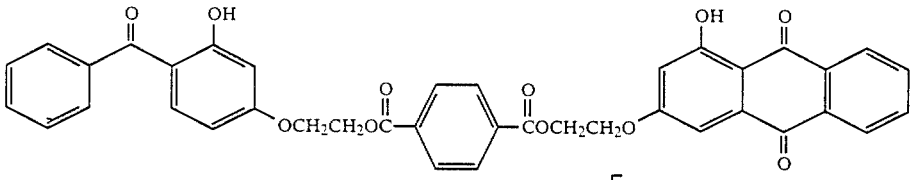

and 930 parts of water.

After impregnation to a wet pickup of 60% the fabric is intermediately dried at 120° C. and thermosoled at 200° C. for 60 seconds.

The result obtained is a gray dyeing which is distinctly better in lightfastness than the same dyeing without the addition of the benzophenone compound.

APPLICATION EXAMPLE 4

A dyeing is carried out in a manner similar to that of Example 2 using the benzophenone compound of the formula

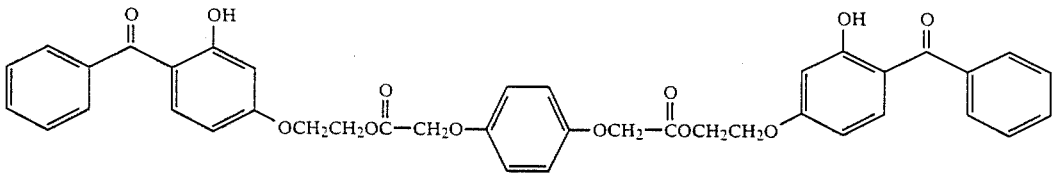

The result obtained is a reddish brown dyeing which in an exposure test in a fadeometer gives distinctly better results than the same dyeing without the addition of the benzophenone compound.

We claim:

1. A process for dyeing textile polyester material with disperse dyes in the presence of benzophenone derivatives to improve light fastness which comprises adding to the dyebath one or more benzophenone derivatives of the formula III (III)

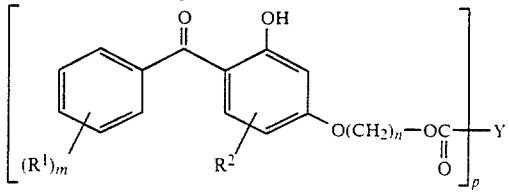

where $R^1$ is alkyl of from 1 to 4 carbon atoms, cyano, fluorine, chlorine, bromine or trifluoromethyl, $R^2$ is hydrogen or alkyl of 1 to 6 carbon atoms, m is 0, 1 or 2 n is 2, 3 or 4 p is 2, 3 or 4, and

Y is a polyvalent radical derived from a polybasic heterocyclic acid selected from the group consisting of thiophene-2,5-dicarboxylic acid, pyridine-2,6-dicarboxylic acid, pyridine-2,5-dicarboxylic acid and pyridine-3,5-dicarboxylic acid, of the formula IV (IV)

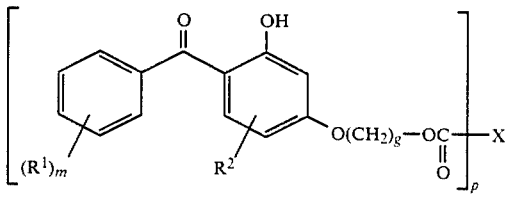

where g is 3 or 4 and $R^1$, $R^2$ m and p are as defined above, and x is a polyvalent radical derived from a polybasic aliphatic, cycloaliphatic aromatic or heterocyclic acid selected from the group consisting of carbonic acid, oxalic acid, malonic acid, succinic acid, glutaric acid, 3,3-dimethylglutaric acid, adipic acid, pimelic acid, suberic acid, azelaic acid, sebacic acid, maleic acid, fumaric acid, glutaconic acid, itaconic acid, citric acid, tricarballylic acid, butane-1,2,3,4-tetracarboxylic acid, ethylenediamine-tetraacetic acid, phthalic acid, isophthalic acid, terephthalic acid, hexahydrophthalic acid, hexahydroisophthalic acid, hexahydroterephthalic acid, 3- and 4-chlorophthalic acid, tetrachlorophthalic acid, m-phenylenediacetic acid, p-phenylenediacetic acid, m-phenylene-dioxyacetic acid, p-phenylenedioxyacetic acid, $4,4^1$-oxydibenzoic acid, diphenic acid, $4,4^1$-biphenyldicarboxylic acid, $4,4^1$-sulfonyldibenzoic acid, $4,4^1$-benzophenonedicarboxylic acid, 2,6-naphtha-alenedicarboxylic acid, trimellitic acid, trimesic acid, pyromellitic acid, hemimellitic acid and those acids of group Y as defined above or of the formula V

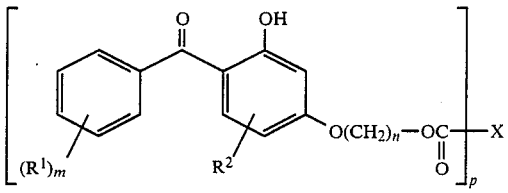

(V)

where $R^1$, $R^2$, m, n, p and X are as defined above, with the proviso that at least one of the radicals $R^1$ and $R^2$ is different from hydrogen.

2. The process according to claim 1, wherein the benzophenone derivative is of the formula III.

3. The process according to claim 1, wherein the benzophenone derivative is of the formula IV.

4. The process according to claim 1, wherein the benzophenone derivative is of the formula V.

* * * * *